US005309797A

United States Patent [19]

Nguyen

[11] Patent Number: 5,309,797

[45] Date of Patent: May 10, 1994

[54] OIL FILTER WRENCH

[76] Inventor: Ri R. Nguyen, 11315 Sandstone St., Houston, Tex. 77072

[21] Appl. No.: 83,309

[22] Filed: Jun. 25, 1993

Related U.S. Application Data

[63] Continuation-in-part of Ser. No. 925,214, Aug. 3, 1992, abandoned.

[51] Int. Cl.[5] ..... B25B 13/52

[52] U.S. Cl. ..... 81/64; 81/3.43; 81/177.6; 81/177.7

[58] Field of Search ..... 81/3.43, 64, 177.6, 81/177.7

[56] References Cited

U.S. PATENT DOCUMENTS

| | | | |
|---|---|---|---|
| 4,334,445 | 6/1982 | Timewell | 81/177.7 |
| 4,750,388 | 6/1988 | Hagen et al. | 81/177.7 X |
| 4,916,993 | 4/1990 | Siekawitch | 81/64 |

*Primary Examiner*—James G. Smith
*Attorney, Agent, or Firm*—Harrison & Egbert

[57] ABSTRACT

A wrench for use on an oil filter having a first curved member with a plurality of apertures formed therein at spaced intervals, a second curved member having a slot at one end so as to receive a first of the first curved member extending therethrough, and a handle extending outwardly of the first and second curved members. The slot includes a locking member affixed thereto. The locking member removably engages one and only one of the apertures of the first curved member. The handle has a first portion affixed to the first and second curved members and extending outwardly therefrom and a second portion hingedly connected to the first portion. The second portion of the handle has a first position in planar alignment with the first portion and a second position in perpendicular relationship to the first portion. The handle has a third portion hingedly connected to an end of the second portion and movable between a position in planar alignment with the first and second portions to a position perpendicular to the second portion.

18 Claims, 3 Drawing Sheets

OIL FILTER WRENCH

RELATED APPLICATIONS

The present application is a continuation-in-part of U.S. patent application Ser. No. 07/925,214, filed on Aug. 3, 1992, and entitled "Wrench", now abandoned.

TECHNICAL FIELD

The present invention relates to wrenches, in general. More particularly, the present invention relates to wrenches which are used for the removing or screwing of a threaded body, such as an oil filter.

BACKGROUND ART

There have been conventional wrenches of which a tightening member is a single curved member, chain, cap, or an interlinking of several curved members for the purpose of forming a circular configuration. The tightening member of the conventional wrench has to be held against the oil filter body with one hand while the other hand rotates the lever in order to make the tightening member tightly engage the oil filter body. This tightening is required to prevent slipping, sliding or drooping from the oil filter body before the removing force or screwing force can be applied. Without this tightening, the removing or screwing operation cannot be performed.

As described hereabove, it is very difficult or impossible to operate the conventional wrench where there is only limited room or space around the oil filter. The reason for this is that the lever arm of the conventional wrench needs a lot of room or space to travel in order to keep the tightening member tightened against the oil filter body. There must still be enough room left for it to travel so as to generate the removing force or screwing force to the oil filter body. Additionally, the conventional wrench cannot be used to remove or screw or oil filters without turning a side. Thirdly, this conventional wrench provides only one size or a very limited size variation for the oil filter body. In the past, other types of wrenches have been used which provide several size ranges by utilizing a movable clamping member. This clamping member stretches outwardly and needs a great deal of room around the oil filter body. Additionally, the conventional wrench cannot be operated in both vertical and horizontal positions if the situation should require.

U.S. Pat. No. 4,916,993, issued on Apr. 17, 1990, describes an adjustable oil filter wrench which includes an adjustable strap for accommodating oil filters of varying diameters. The straps are secured to an aligned handle and provided with an arcuate saddle for accepting an adjustably pivotal band therein for application of torque to the band over a substantial circumferential surface of the oil filter. A worm screw is provided which simultaneously engages several of the apertures formed in the band for threadedly and continuously adjusting the diameter of the wrench.

U.S. Pat. No. 4,750,388, issued on Jun. 14, 1988, to Hagen shows an oil filter gripping tool that includes a looped band, the ends of which are connected to scissor levers through a pair of double pivot hinges. The hinges allow movement of the levers to tighten the band to contract to closely fit and grip the oil filter. With the band tightened about the oil filter, turning the levers causes rotation of the oil filter.

It is an object of the present invention to provide an oil filter wrench of simple and inexpensive construction.

It is another object of the present invention to provide a wrench which provides the tightening members which can tightly engage the oil filter body without slipping, drooping or sliding.

It is another object of the present invention to provide an improved wrench which is applicable to any size of existing oil filter.

It is a further object of the present invention to provide an improved wrench which can operate in very limited spaces around the oil filter body.

It is still another object of the present invention to provide an improved wrench which can remove or screw the oil filter with the lever arm in a vertical and/or horizontal position.

It is still another object of the present invention to provide an improved wrench which can operate in both clockwise and counter-clockwise directions without sliding.

These and other objects and advantages of the present invention will become apparent from a reading of the attached specification and appended claims.

SUMMARY OF THE INVENTION

The present invention is a wrench for an oil filter that comprises a first curved member having a plurality of apertures formed therein at spaced intervals along a length of the first curved member, a second curved member having a slot at one end such that the first curved member extends within the slot, and a handle extending outwardly of the first and second curved members. The first curved member extends in generally overlapping relationship with the second curved member. The slot of the second curved member has a locking member affixed thereto. This locking member serves to fix the position of one of the curved members with respect to the other curved member. The locking member removably engages one and only one of the apertures of the first curved member.

The first curved member includes a slide area formed at an end opposite the handle. The second curved member has a portion extending through this slide area. The plurality of apertures comprise a plurality of holes that are formed centrally between the sides of the first curved member. The looking member extends through one of these holes. The first and second curved members define a circular interior area of expandable diameter. The diameter is expandable at discrete and separate intervals.

The locking member includes a locking screw which is threadedly received by the slot. The locking screw rotatably engages one of the apertures. The slot forms a rectangular housing. The first curved member extends through this rectangular housing. One side of the rectangular housing has a threaded hole formed therein. The locking member is received within this threaded hole.

The first curved member has an end affixed to one side of the handle. The second curved member has an end affixed to an opposite side of the handle. The handle of the present invention specifically comprises a first portion affixed to the first and second curved members and extending outwardly therefrom, and a second portion hingedly connected to the first portion. The second portion has a first position in planar alignment with the first portion. The second portion is movable to a second position perpendicular to the first portion. The handle also includes a third portion which is hingedly connected to an end of the second portion opposite the first portion. This third portion has a first position in planar alignment with the first and second portions. The third portion is movable to a second position perpendicular to the second portion.

DETAILED DESCRIPTION OF THE INVENTION

Figure 1:
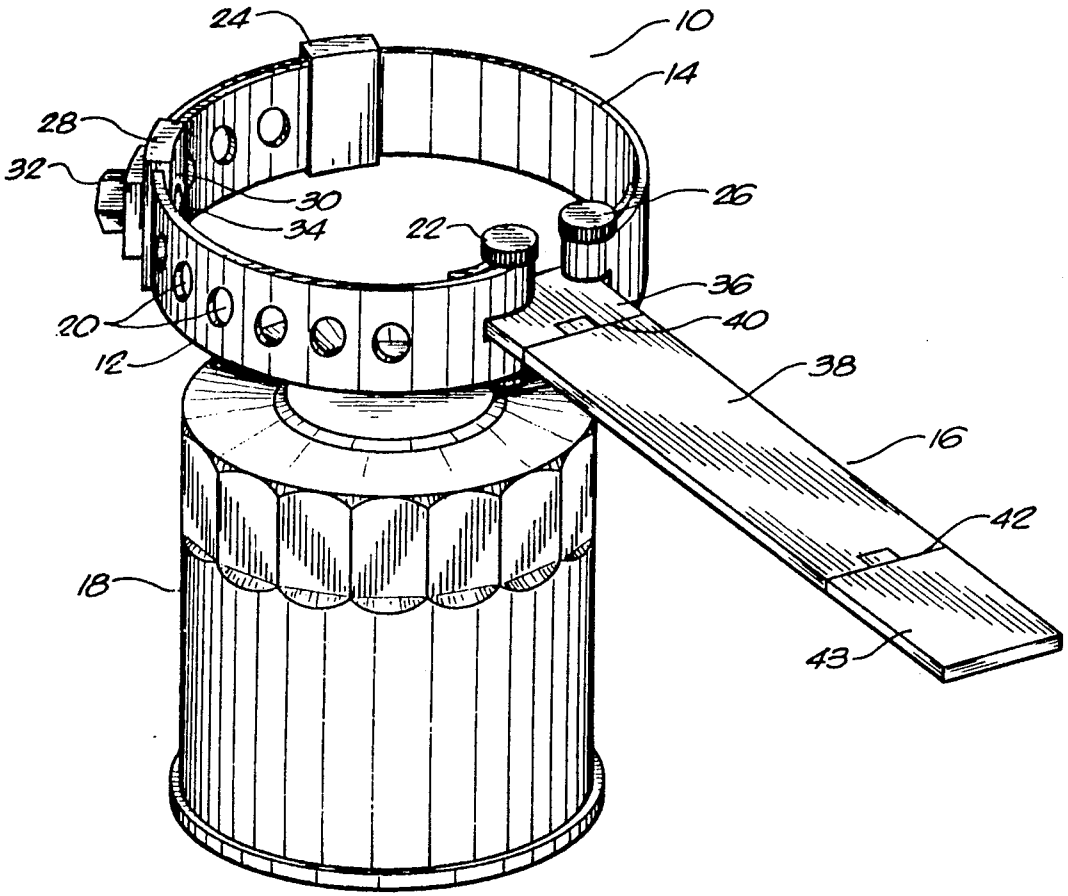
FIG. 1 is a perspective view of the oil filter wrench in accordance with the preferred embodiment of the present invention.

Referring to FIG. 1, there is shown at 10 the oil filter wrench in accordance with the preferred embodiment of the present invention. The oil filter wrench 10 comprises a first curved member 12, a second curved member 14, and a handle 16. The oil filter wrench 10 has a circular interior area defined by the first curved member 12 and the second curved member 14 for the purpose of extending around the outer diameter of the oil filter 18.

As can be seen in FIG. 1, the first curved member 12 has a plurality of apertures 20 formed therein. Specifically, the apertures 20 are holes which are formed centrally between the sides of the first curved member 12. The apertures 20 are formed at spaced intervals along the length of the first curved member 12. The first curved member 12 has an end 22 which is affixed to one side of the handle 16. A pivot member is used at the end 22 so as to secure the end of the first curved member 12 to the handle 16. The first curved member 12 includes a slide area 24 at an end opposite the handle 16. The second curved member 14 extends through the interior of the slide area 24. Essentially, the slide area 24 secures the end of the first curved member 12 in generally close overlapping relationship with the second curved member 14.

The second curved member 14 has one end 26 affixed to another side of a handle 16. The end 26 is secured by a pivot to the side of the handle 16. The second curved member 14 has a slot 28 formed at an end opposite end 26. As can be seen, the slot 28 receives the first curved member 12 so as to secure the first curved member 12 in generally overlapping relationship with the second curved member 14. The slot 28 formed a generally rectangular housing 30. As can be seen, the rectangular housing 30 extends around the exterior of the first curved member 12. One portion of the rectangular housing 30 is secured to an end of the second curved member 14. Another side of the rectangular housing 30 extends around a back surface of the first curved member 12. A locking member 32 is affixed to the slot 28. The locking member serves to fix one of the curved members 12 and 14 with respect to the other of the curved members. The locking member 32 is configured so as to engage one of the apertures 20 on the first curved member 12. Specifically, the locking member 32 is a locking screw which is threadedly received by the slot 28. A rotation of the locking screw serves to engage one of the apertures 20. In contrast to the prior art, the locking member 32 engages one, and only one, of the apertures 20. As will be described hereinafter, the locking member 32 extends through the rectangular housing for the purpose of securing the first curved member 12 with respect to the second curved member 14. A threaded hole 34 is formed on a side of the rectangular housing 30 so as to receive an end of the locking screw 32. In order to release the fixed relationship of the first curved member with respect to the second curved member 14, the locking member 32 is unscrewed so that the screw is separated from the apertures 20.

The handle 16 includes a first portion 36 which is affixed to the first curved member 12 and to the second curved member 14. The first portion 36 extends outwardly from these curved members 12 and 14. The handle 16 includes a second portion 38 which is hingedly connected at 40 to the first portion 36. The second portion 38 is illustrated in its first position in planar alignment with the first portion 36. The second portion 38 is pivotally movable to a second position which is perpendicular to the first portion 36. The handle 16 includes a third portion 40 which is hingedly connected at 42 to an end of the second portion 38 opposite the first portion 36. This third portion 40 has a first position in planar alignment with the first portion 36 and the second portion 38. The third portion 40 is also movable to another position which is perpendicular to the second portion 38.

In order to secure the oil filter wrench 10 around the outer diameter of the oil filter 18, the first curved member 12 is moved relative to the second curved member 14 so as to approximate the outer diameter of the oil filter 18. The locking member 32 is then secured through one of the apertures 20 so as to fix the position of the curved members. The wrench 10 is then placed around the outer diameter 18. Leverage is applied to handle 16 so as to properly rotate the oil filter 18.

Figure 2:
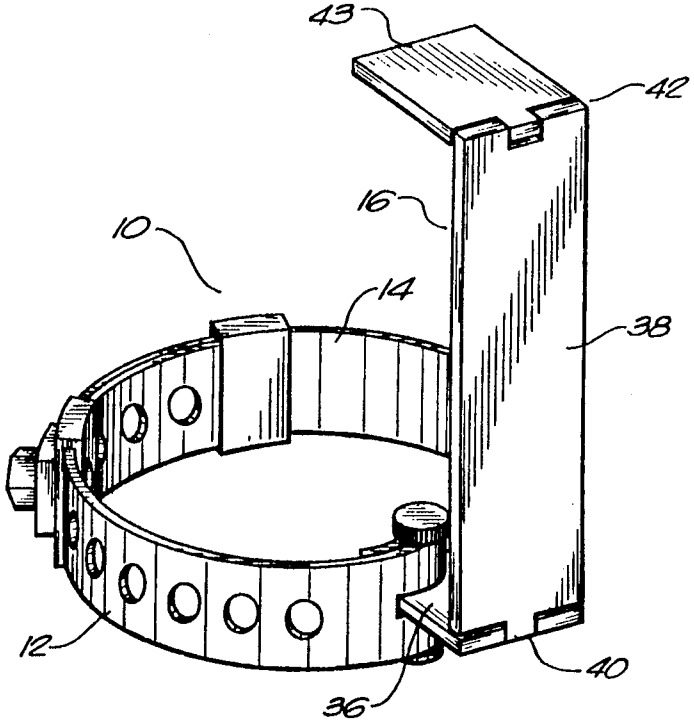
FIG. 2 is a perspective view of the oil filter wrench of the present invention with the handle in an upright position.

Often, when it is necessary, the handle 16 must be used in a confined area. As such, the handle 16 is configured in several hinged segments so as to facilitate the use of the wrench 10 in a confined area. FIG. 2 illustrates the manner in which the handle 16 can be folded for use in a confined area.

In FIG. 2, it can be seen that the first curved member 12 is affixed to one side of the first portion 36 of handle 16. Similarly, the second curved member 14 is connected to an opposite side of the first portion 36. The second portion 38 has been moved to its second position generally perpendicular to the first portion 36. Specifically, the second portion 38 will pivot about hinge 40 so as to assume this upward vertical position. For added leverage, the third portion 43 is pivoted about its hinge 42 so as to extend inwardly in generally parallel relationship to the first portion 36 and in perpendicular relationship to the second portion 38. This configuration of the oil filter wrench 10 can allow the user to apply proper rotational forces for the removal of the oil filter from the engine of the automobile.

Figure 3:
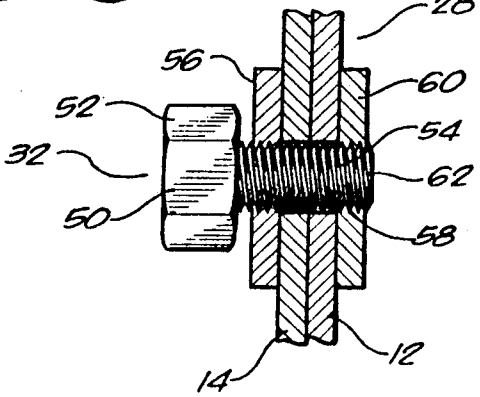
FIG. 3 is a cross-sectional view showing the locking member of the present invention.

FIG. 3 is a detailed view illustrating the configuration of the locking member 32. Specifically, in FIG. 3, it can be seen that the locking member S2 includes a locking screw 50 which has a head 52 and a threaded portion 54. A locking screw 50 extends through a first surface 56 of the slot 28. The locking screw 50 has the threaded portion extending through a hole 58 formed on the back side of the rectangular configuration of slot 28. The locking screw 50 also extends through one of the apertures 20 formed on the first curved member 12. The surface 56 is supported on the second end of the second curved member 14. By rotating the head 52 of the locking screw 50, the threaded portion 54 will extend through the aperture 20 of the first curved member 12 and into the threaded opening 58 of the back surface 60 of the rectangular configuration of slot 28. When it is desired to release the curved members for the purposes of expanding or contracting the interior diameter of the oil filter wrench 10, then the head 52 of the locking screw 50 is rotated in the opposite direction such that the end 62 of the locking screw 50 will reside within the area of the surface 56 of the slot 28.

Figure 4:
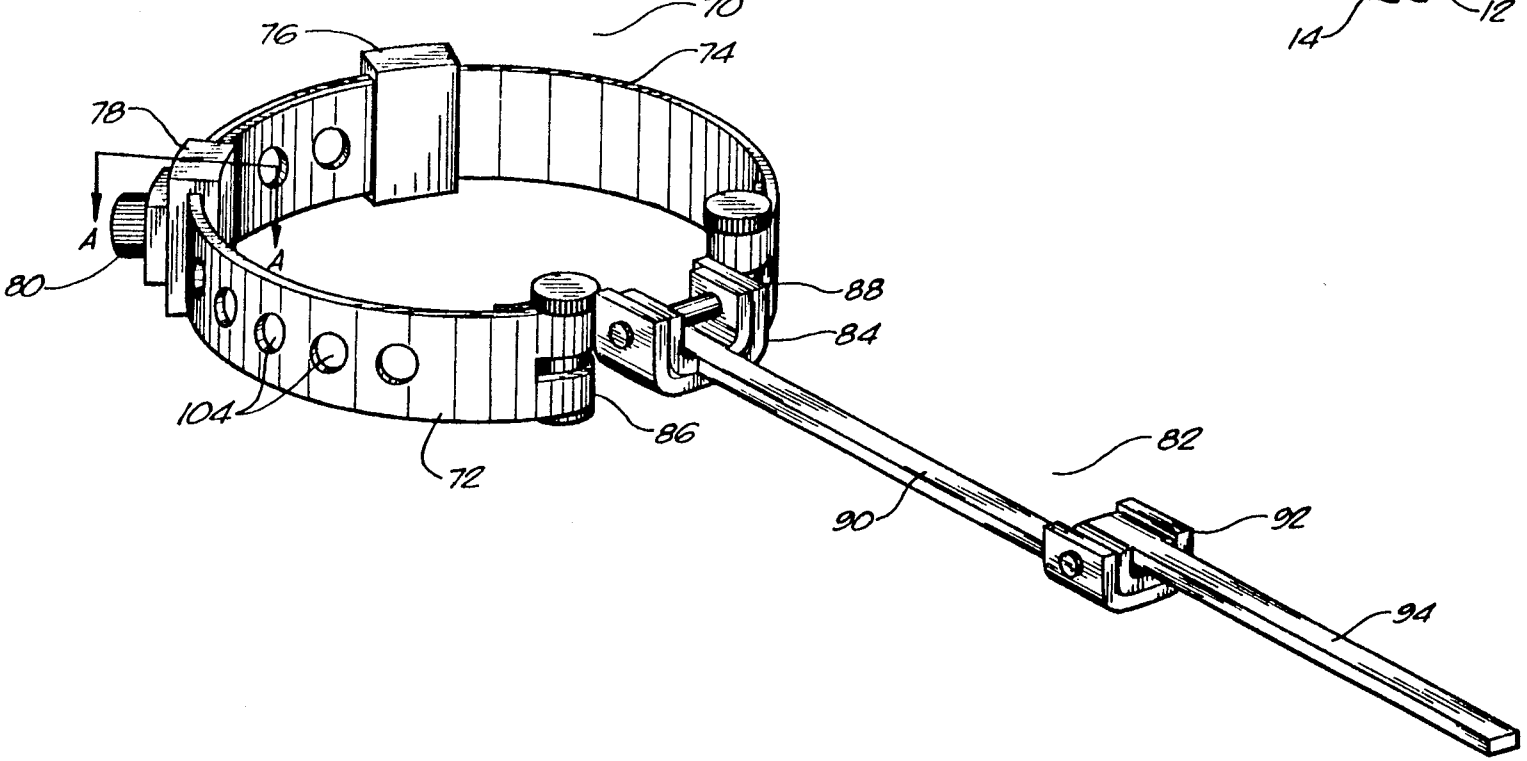
FIG. 4 is a perspective view of an alternative embodiment of the oil filter wrench of the present invention.

FIG. 4 shows an alternative embodiment of the present invention. In the alternative embodiment of the present invention, it can be seen that the oil filter wrench 70 includes a first curved member 72 and a second curved member 74. These first and second curved members have a configuration similar to that described herein previously. The first curved member 72 has a slide area 76 affixed to one end. The second curved member 74 has a slot 78 affixed to one end. The slot 78 includes the locking member 80. Importantly, in the alternative embodiment of the present invention, the handle 82 has a first portion 84 which is affixed to one end 86 of the first curved member 72 and to an end 88 of the second curved member 74. This first portion 84 has a generally U-shaped configuration. The second portion 90 of handle 82 is pivotally connected to the U-shaped configuration of the first portion 84. The second portion 90 is a strut which extends outwardly from the first portion 84. The second portion 90 also includes another U-shaped configuration 92 at an end opposite the first portion 84. The third portion 94 of the handle 82 is pivotally received and nested within the U-shaped configuration 92 of the second portion 90. The second portion 90 and the third portion 94 extend outwardly from the first curved member 72 and the second curved member 74 in generally linear alignment.

Figure 5:
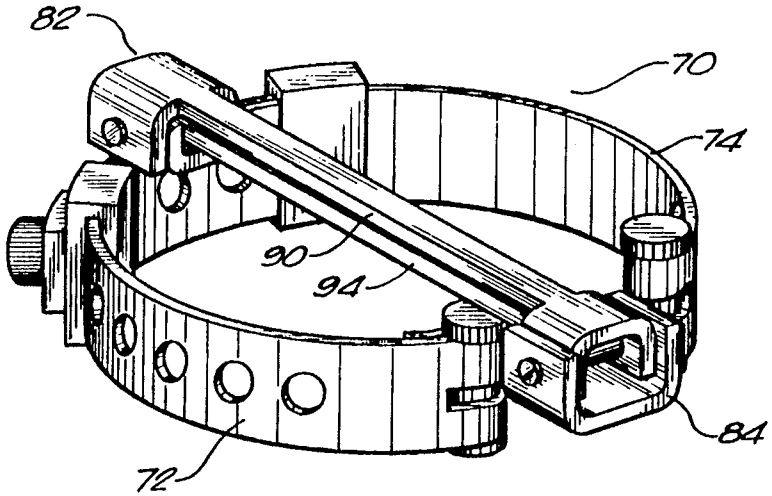
FIG. 5 is a perspective view of the alternative embodiment of the oil filter wrench of the present invention showing the handle in a folded configuration.

In FIG. 5, the handle 82 is shown as assuming a variety of configurations. In FIG. 5, the handle 82 can be folded over the top surface of the first curved member 72 and the second curved member 74 for storage purposes. Specifically, the second portion 90 is rotated approximately 180° relative to the first portion 84. The second portion 90 will overly the top of the first curved member 72 and the second curved member 74. Similarly, the third portion 94 will fold over the second portion 90 in generally overlapping relationship and will fold so as to be nested within the U-shaped configuration of the first portion 84.

If it is desired to use the oil filter wrench in a confined environment, then the second portion 90 can be extended vertically upwardly relative to the first portion 84. Similarly, the third portion 94 can rotate so as to assume a position which is in linear alignment with the second portion 90 or which is perpendicular to the second portion 90. The pivotability of the portions 90 and 94 with respect to each other greatly facilitates the adaptability of the oil filter wrench 70 of the present invention.

Figure 6:
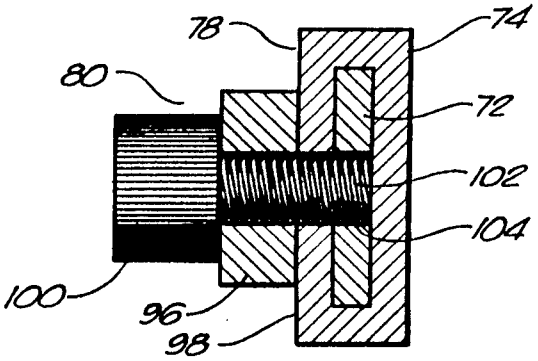
FIG. 6 is a cross-sectional view of the locking member of the present invention as taken across lines A—A of FIG. 4.

FIG. 6 illustrates the manner in which the locking member 80 operates to secure the first curved member 72 with respect to the second curved member 74. In FIG. 6, it can be seen that the slot 78 has a generally rectangular configuration. The first curved member 72 extends through the interior of the rectangular configuration. A nut 96 is affixed to a back surface 98 of the rectangular configuration of slot 78. A locking screw 100 is threadedly received within the threaded area of nut 96 and extends into the interior of the rectangular configuration of slot 78. In this manner, the threaded portion 102 of the locking screw 100 serves to engage one of the apertures 104 of the first curved member 72. When it is desired to release the first curved member 72 with respect to the second curved member 74, the locking screw 100 is simply rotated in the opposite direction until the end of the locking screw 100 is separated from the first curved member 72.

In keeping with the present invention, it should be noted that various types of apertures can be provided on the first curved member. For example, slots can be formed in the edge or the side of the first curved member. A lock or clamp can be affixed to the slot so as to engage the apertures or slots.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A wrench for use on an oil filter comprising:

a first curved member having a plurality of apertures formed therein at spaced intervals along a length of said first curved member;

a second curved member having a slot at one end, said first curved member extending within said slot in generally overlapping relationship with said first curved member, said slot having a locking member affixed thereto, said locking member for fixing one of said curved members with respect to the other of said curved members, said locking member removably engaging one and only one of said apertures of said first curved member, said locking member comprising a locking screw threadedly received by said slot, said locking screw rotatably engaging said one of said apertures; and a handle extending outwardly of said first and second curved members, said first and second curved members having an end affixed to said handle.

2. The wrench of claim 1, said first curved member having a slide area formed at an end opposite said handle, said second curved member having a portion extending through said slide area.

3. The wrench of claim 1, said plurality of apertures comprising a plurality of holes formed centrally between sides of said first curved member, said looking member extending through one of said holes.

4. The wrench of claim 1, said first and second curved members defining a circular interior area of expandable diameter.

5. The wrench of claim 1, said slot forming a rectangular housing, said first curved member extending through an interior of said rectangular housing, one side of said rectangular housing having a threaded hole formed therein, said locking member received within said threaded hole.

6. The wrench of claim 5, said rectangular housing having another hole formed on an opposite side of said rectangular housing, said another hole receiving an end of said locking member when said locking member passes through said aperture of said first curved member.

7. The wrench of claim 1, said first curved member having an end affixed to one side of said handle, said second curved member having an end affixed to an opposite side of said handle.

8. The wrench of claim 1, said handle comprising:

a first portion affixed to said first and second curved members and extending outwardly therefrom; and a second portion hingedly connected to said first portion, said second portion having a first position in planar alignment with said first portion, said second portion movable to a second position perpendicular to said first portion.

9. The wrench of claim 8, further comprising:

a third portion hingedly connected to an end of said second portion opposite said first portion, said third portion having a first position in planar alignment with said first and second portions, said third portion movable to a second position perpendicular to said second portion.

10. A wrench for use on an oil filter comprising:

a first curved member having a plurality of apertures formed therein at spaced intervals along a length of said first curved member;

a second curved member having a slot at one end, said first curved member extending within said slot in generally overlapping relationship with said first curved member, said slot having a locking member affixed thereto, said locking member for fixing one of said curved members with respect to the other of said curved members, said locking member removably engaging one and only one of said apertures of said first curved member, and a handle extending outwardly of said first and second curved members, said first and second curved members having an end affixed to said handle, said handle comprising:

a first portion affixed to said first and second curved members and extending outwardly therefrom; and a second portion hingedly connected to said first portion, said second portion having a first position in planar alignment with said first portion, said second portion movable to a second position perpendicular to said first portion, said first portion having a generally U-shaped configuration, said second portion having an end pivotally mounted in said first portion, said second portion foldable to a third position extending over said first and second curved members.

11. The wrench of claim 10, said second portion being a strut extending outwardly from said U-shaped configuration of said first portion.

12. The wrench of claim 11, further comprising:

a third portion extending outwardly from said second portion, said third portion movable between a first position in linear alignment with said first and second portions to a second position overlying said second portion.

13. The wrench of claim 12, said second portion having a U-shaped configuration at an end opposite said first portion, said third portion nested within said U-shaped configuration of said second portion.

14. A wrench for use on an oil filter comprising:

a first curved member having a plurality of apertures formed therein at spaced intervals along a length of said first curved member;

a second curved member having a slot formed thereon, said first curved member extending within said slot in generally overlapping relationship with said second curved member, said slot having a locking member affixed thereto, said locking member for fixing one of said first curved members with respect to the other curved member, said first and second curved members defining a circular interior area of expandable diameter, said circular interior area expandable at discreet intervals; and a handle extending outwardly of said first and second curved members, said first and second curved members each having an end affixed to said handle, said handle comprising:

a first portion affixed to said first and second curved members and extending outwardly therefrom; and a second portion hingedly connected to said first portion, said second portion having a first portion in planar alignment with said first portion, said second portion movable to a second portion generally perpendicular to said first portion.

15. The wrench of claim 14, said handle further comprising:

a third portion hingedly connected to an end of said second portion opposite said second portion, said third portion having a first position in planar alignment with said first and second portions, said third portion movable to a second position perpendicular to said second portion.

16. The wrench of claim 14, said first portion having a generally U-shaped configuration, said second portion having an end pivotally mounted in said first portion, said second portion foldable to a third position extending over said first and second curved members.

17. The wrench of claim 14, said handle further comprising:

a third portion extending outwardly from said second portion, said third portion movable between a first position in linear alignment with said first and second portions to a second portion overlying said second portion.

18. The wrench of claim 14, said locking member being a threaded member received within said slot for removably engaging one and only one of said apertures of said first curved member, said locking member rotatably movable between a first position extending through said one of said apertures to a second position distal said aperture.

* * * * *